US007757510B2

(12) United States Patent
Rosete et al.

(10) Patent No.: US 7,757,510 B2
(45) Date of Patent: Jul. 20, 2010

(54) CABINET FOR AN AIR HANDLER UNIT

(75) Inventors: Jose A. Rosete, Del. Benito Juarez (MX); George Calienes, Miami, FL (US); Oscar Enrique Barrios González, Del. Azcapotzalco (MX)

(73) Assignee: AAF-McQuay, Inc., Plymouth, MN (US)

( * ) Notice: Subject to any disclaimer, the term of this patent is extended or adjusted under 35 U.S.C. 154(b) by 265 days.

(21) Appl. No.: 11/811,908

(22) Filed: Jun. 12, 2007

(65) Prior Publication Data

US 2007/0290586 A1 Dec. 20, 2007

Related U.S. Application Data

(60) Provisional application No. 60/804,902, filed on Jun. 15, 2006.

(51) Int. Cl.

| | |
|---|---|
| ***F25D 19/00*** | (2006.01) |
| ***A47B 96/04*** | (2006.01) |
| ***A47B 43/00*** | (2006.01) |
| ***A47G 29/00*** | (2006.01) |

(52) U.S. Cl. ..... 62/298; 312/257.1; 312/263; 312/265.1; 312/400; 52/309.9; 52/781; 52/794.1

(58) Field of Classification Search ..... 62/298, 62/404, 426; 312/326, 400, 401, 236, 257.1, 312/263, 234, 265, 265.1; 428/57, 119; 52/276, 52/309.9, 780, 781, 794.1, 800.12

See application file for complete search history.

(56) References Cited

U.S. PATENT DOCUMENTS

| | | | | |
|---|---|---|---|---|
| 5,348,778 | A * | 9/1994 | Knipp et al. | 312/401 |
| 5,870,868 | A | 2/1999 | Kita et al. | |
| 6,026,620 | A * | 2/2000 | Spude | 52/275 |
| 6,350,000 | B1 | 2/2002 | Van Benthem et al. | |
| 6,497,256 | B1 | 12/2002 | Adams et al. | |
| 6,530,191 | B2 | 3/2003 | Rieke et al. | |
| 6,658,904 | B2 | 12/2003 | Herbeck et al. | |
| 6,676,234 | B2 | 1/2004 | Herbeck et al. | |
| 6,820,952 | B2 | 11/2004 | Austin et al. | |
| 2002/0062739 | A1 * | 5/2002 | Cheng | 96/66 |
| 2005/0035697 | A1 * | 2/2005 | Chen | 312/257.1 |
| 2005/0055919 | A1 * | 3/2005 | Dubensky et al. | 52/302.1 |

* cited by examiner

*Primary Examiner*—Frantz F Jules
*Assistant Examiner*—Daniel C Comings
(74) *Attorney, Agent, or Firm*—Patterson Thuente Christensen Pedersen, P.A.

(57) ABSTRACT

A cabinet for an air handling unit includes a cabinet assembly being formed framelessly of a plurality of panel assemblies, each panel assembly being formed of two spaced apart metallic panels embracing an intermediate core and wherein the plurality of panel assemblies provides the structural strength of the cabinet assembly. A method of forming a cabinet for an air handling unit is further included.

16 Claims, 10 Drawing Sheets

CABINET FOR AN AIR HANDLER UNIT

RELATED APPLICATION

The present application claims the benefit of U.S. Provisional Application No. 60/804,902 filed Jun. 15, 2006, which is incorporated herein in its entirety by reference.

FIELD OF THE INVENTION

The present invention relates generally to cabinets for air handler units. More particularly, the present invention relates to a cabinet having a paneled construction.

BACKGROUND OF THE INVENTION

Cabinets for air handler units (AHU) are used for housing air conditioning equipment, such as a heat exchanger coil for heating or cooling air, and a fan for circulating conditioned air through ductwork. Traditionally, the cabinet for the AHU has been constructed of sheet metal fastened to a framework. Components contained in the AHU cabinet, such as the heat exchanger or fan, can be quite heavy, requiring additional framework to be added to the AHU cabinet.

The sheet metal sides of a traditional AHU cabinet readily conduct heat and fail to provide a thermal barrier between the air inside the unit and the air outside of the unit. Disadvantageously, heat is therefore able to flow into or out of the AHU cabinet. In situations where the AHU cabinet is carrying cooled air, this flow of energy into or out of the AHU cabinet can be costly and present increased strain on the air conditioning equipment. A further problem with traditional AHU cabinets occurs when the unit is mounted in an unconditioned space, and the unit is carrying cooled air. Condensation forms on the outer sides of the AHU cabinet, and the condensation can run off of the unit onto the floor or onto other equipment. Water on the floor below an AHU cabinet can produce mold, as well as unsafe, slippery conditions, and water transferred to nearby equipment can cause corrosion or other damage.

SUMMARY OF THE INVENTION

The present invention overcomes the deficiencies of the prior art air handler units. The AHU cabinet of the present invention broadly includes a plurality of sandwich panels joined together with channel-like structures. The panels are joined to one another, rather than being secured to a framework. The AHU cabinet may include multiple components therein, such as a heat exchanger coil, a damper, and a fan assembly. The panels used in the AHU cabinet support the components mounted inside the unit, and also provide a thermal barrier between the air inside the unit and the air outside of the unit. The AHU cabinet may further include one or more mounting brackets for securing the AHU cabinet in place.

It is an object of the present invention to provide an air handler unit having lighter weight than traditionally-constructed units. It is a further object to provide an AHU cabinet having fewer parts and being less complex to manufacture than prior air handler units. A still further object of the present invention is to provide an AHU cabinet having high energy efficiency.

The present invention is a cabinet for an air handling unit including a cabinet assembly being formed of a plurality of panel assemblies, each panel assembly being formed of two spaced apart metallic panels embracing an intermediate core and wherein the plurality of panel assemblies provides the structural strength of the cabinet assembly. The present invention is further a method of forming a cabinet for an air handling unit.

BRIEF DESCRIPTION OF THE DRAWINGS

The invention may be more completely understood in consideration of the following detailed description of various embodiments of the invention in connection with the accompanying drawings, in which.

DETAILED DESCRIPTION OF THE DRAWINGS

Figure 1:
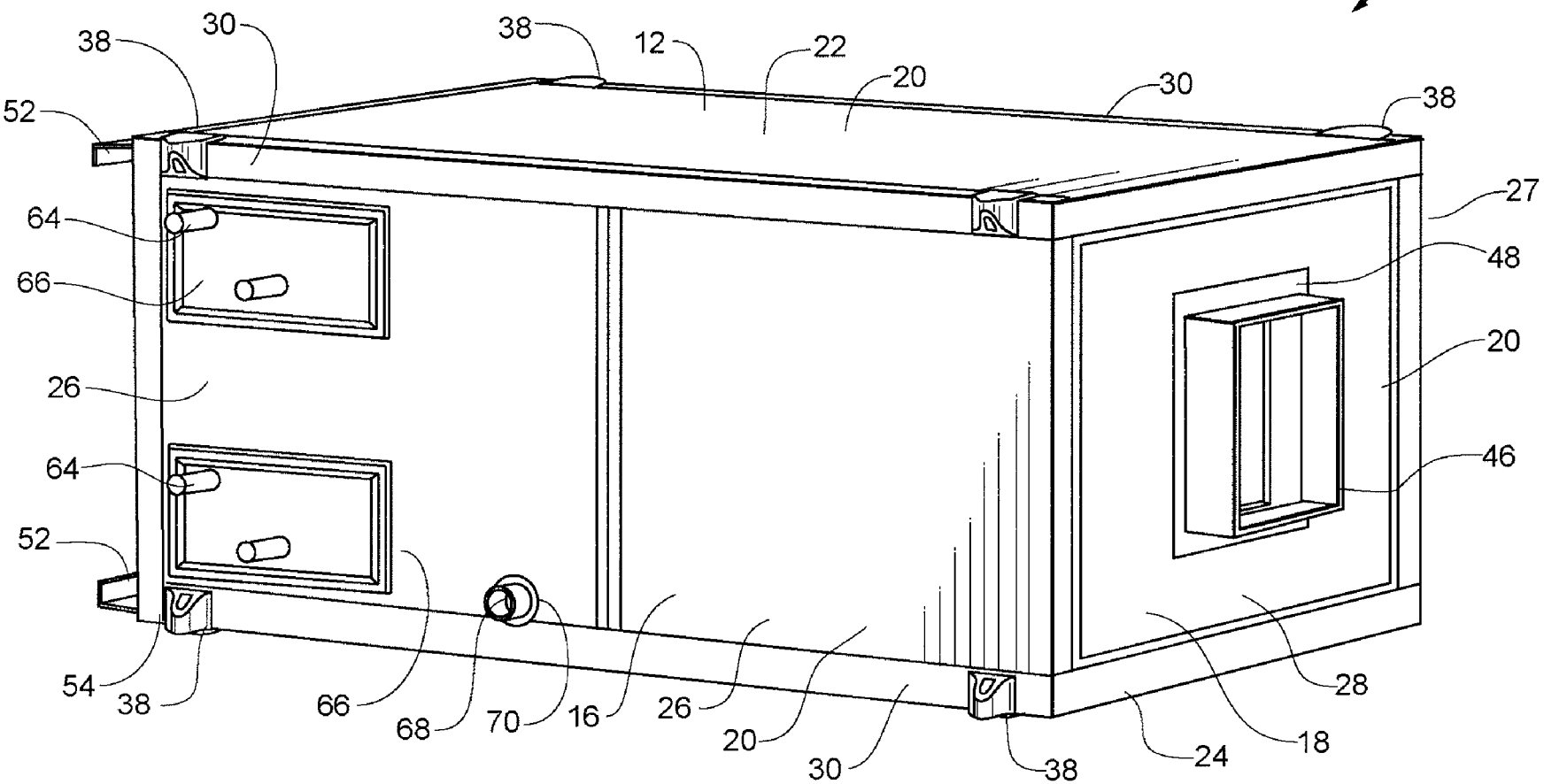
FIG. 1 is a perspective view of an air handler unit cabinet according to the invention.

In the following detailed description of the present invention, numerous specific details are set forth in order to provide a thorough understanding of the present invention. However, it will be obvious to one skilled in the art that the present invention may be practiced without these specific details. In other instances, well-known methods, procedures, and components have not been described in detail so as to not unnecessarily obscure aspects of the present invention.

As depicted in FIGS. 1-7, the cabinet assembly 12 of an air handler unit (AHU) cabinet 10 generally includes a top portion 13, a base 14, a first side 16, a second side 17, a first end 18 and a second end 19. The structure of cabinet assembly 12 is comprised of a plurality of panel assemblies 20 that provide the structural strength of the cabinet assembly 12 that in the prior art was formerly provided by a frame. Significantly, the panel assemblies 20 provide that requisite structural strength by being formed of a sandwich design having two spaced apart metallic panels embracing an intermediate core, as is detailed below.

Figure 2:
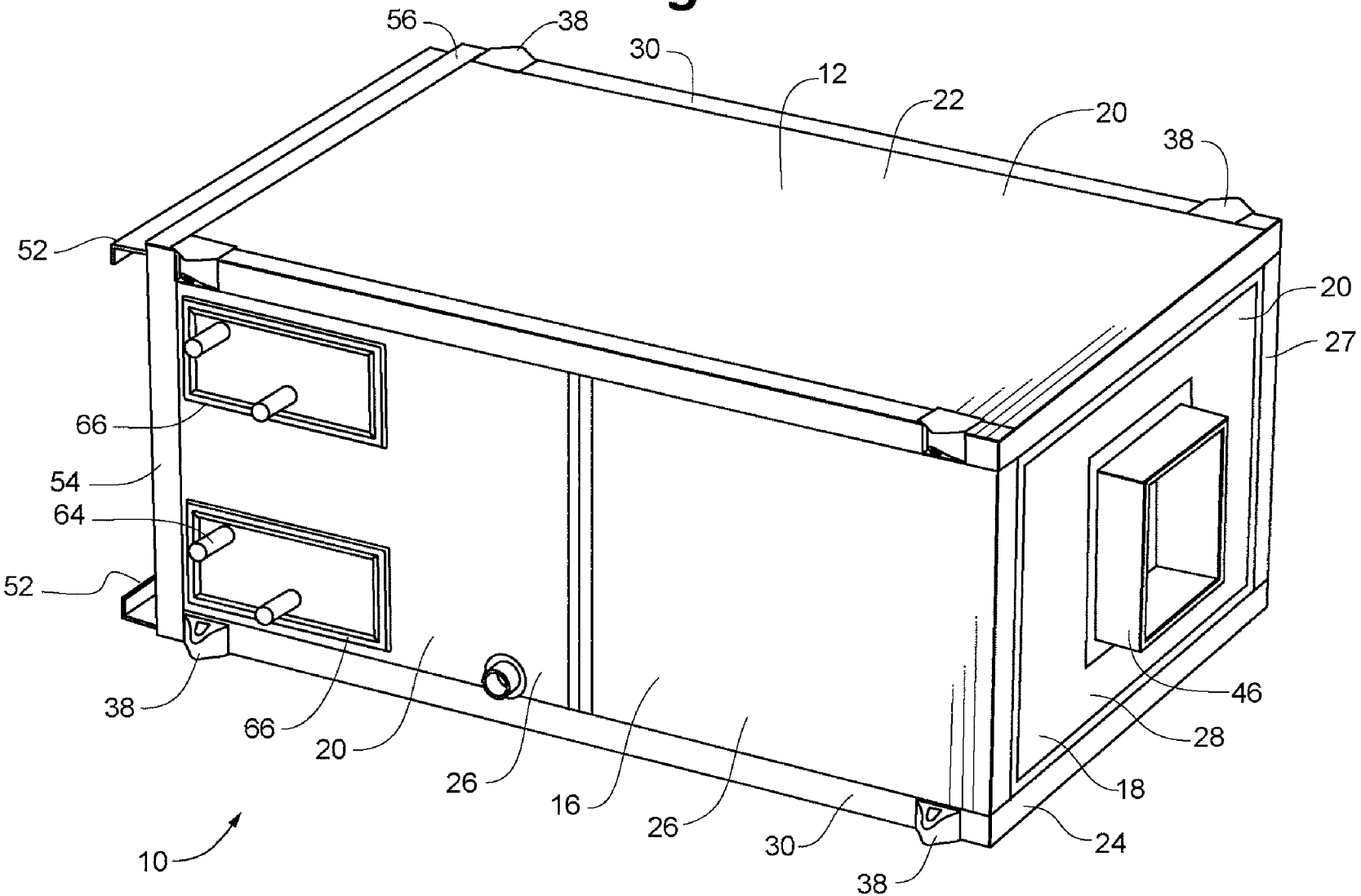
FIG. 2 is a further perspective view of an air handler unit cabinet according to the invention.

Adjacent sandwich panel assemblies 20 are joined together with channel members 30. The panel assemblies 20 are joined to one another, rather than being secured to a framework as in the prior art, and preferably include a top panel 22, a bottom panel 24, one or more first side panels 26, one or more second side panels 27, a first end panel 28, and a second end panel 29. In a preferred embodiment, first side 16 of cabinet assembly 12 comprises two first side panels 26, and second side 17 comprises two second side panels 27, as depicted in FIGS. 1 and 2. The use of two panel assemblies 20 on each of sides 16 and 17 may be advantageous for construction and/or servicing of cabinet assembly 12, although single longer panel assemblies 20 may be used as well to form the sides 16, 17. Panel assemblies 20, advantageously formed of a generally common size, may be added or subtracted for either increasing or decreasing the size of the AHU cabinet 10 as desired.

A plurality of panel-mounting channel members 30 are provided for securing panel assemblies 20 to one another. Each panel-mounting channel member 30 includes a channel portion 32 for receiving the edge of a panel 20, and a lip portion 34 for securing panel-mounting channel member 30 to the face of an adjacent panel 20.

Channel members 30 further comprise vertical support beams 36 that are used if cabinet assembly 12 includes multiple first side panels 26 and/or multiple second side panels 27. Support beams 36 span between top panel 22 and bottom panel 24. If multiple first side panels 26 and/or multiple second side panels 27 are used, the side panels 26, 27 can be fastened to support beams 36, ensuring proper alignment of the side panels 26, 27. The support beams 36 are generally T shaped in cross section such that the base of the T abuts the end margins of the respective adjacent panels 26 and 27 while the cross member of the T overlies in part the exterior margin of the respective adjacent panels 26 and 27.

Air handler unit cabinet 10 may also include one or more mounting brackets 38 for securing AHU cabinet 10, for example by fastening AHU cabinet 10 to the ground or other structure, or by suspending cabinet assembly 12 from an overhead location. The lower brackets 38, as depicted in FIG. 3, are for mounting the cabinet assembly 12 to the structure underlying the cabinet assembly 12 and the upper brackets 38, as depicted in FIGS. 3 and 4, are for suspending the AHU cabinet 10 from an overhead structure.

Figure 3:
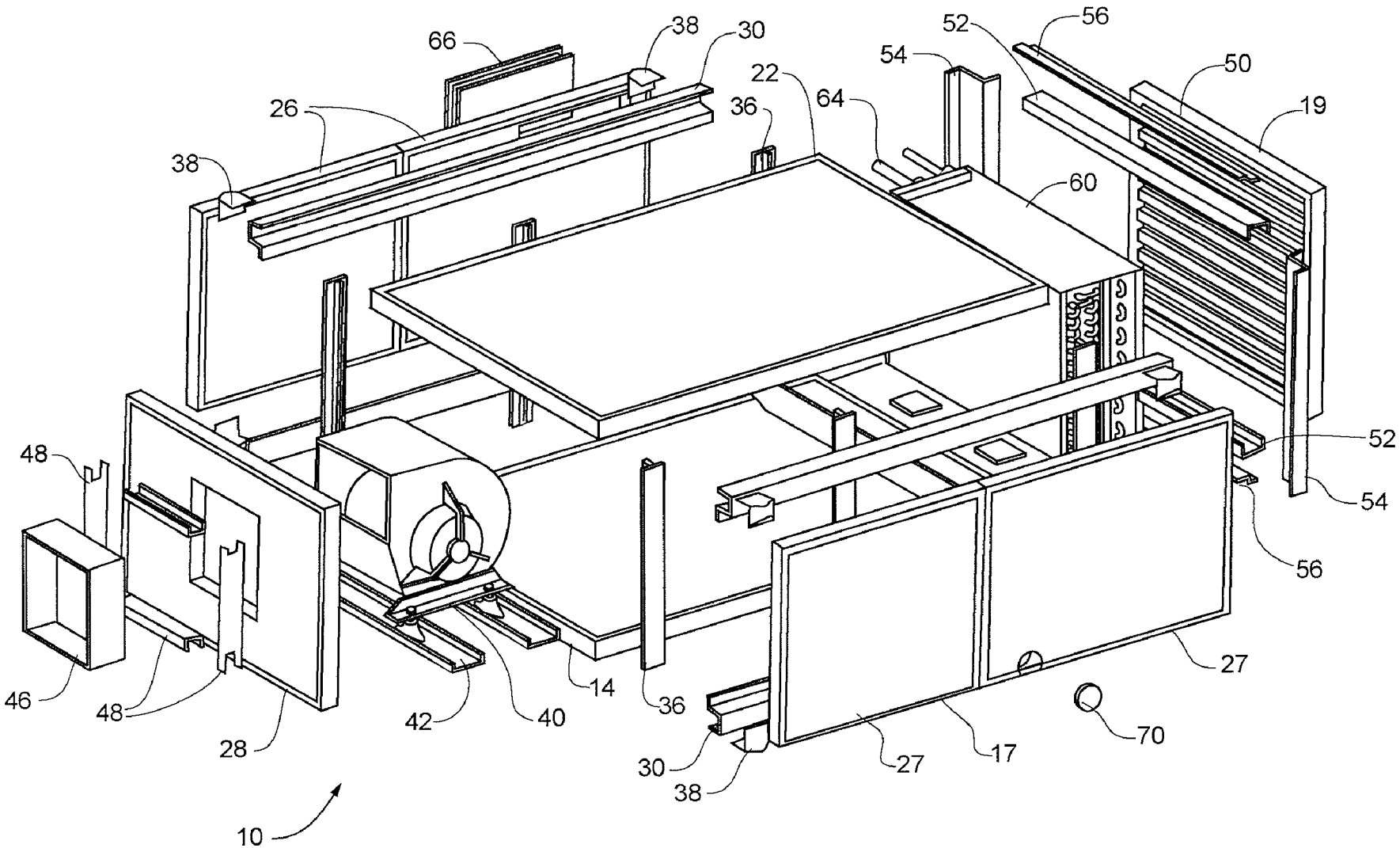
FIG. 3 is an exploded perspective view of an air handler unit cabinet according to the invention.
Figure 4:
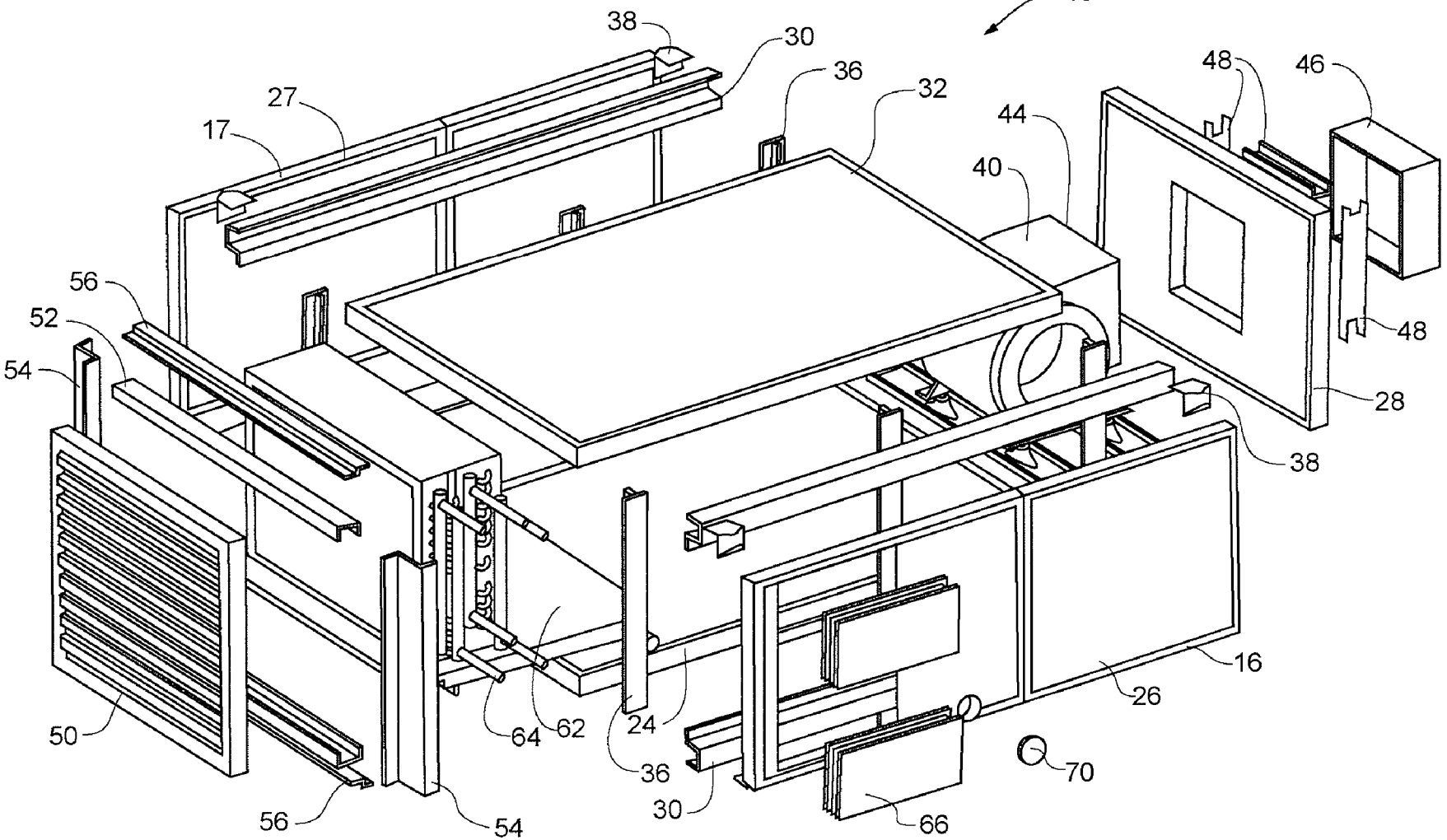
FIG. 4 is a further exploded perspective view of an air handler unit cabinet according to the invention.
Figure 5:
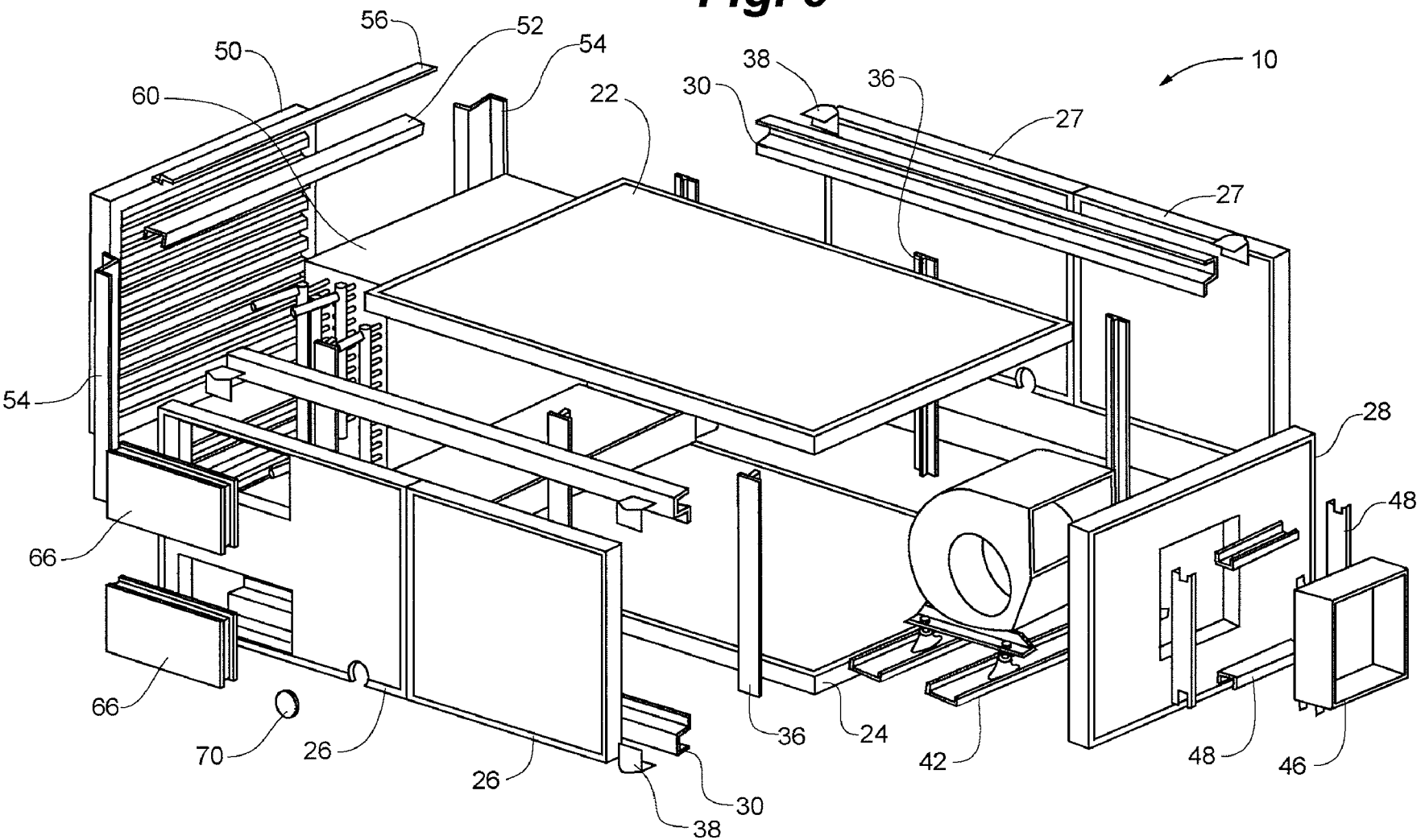
FIG. 5 is a still further exploded perspective view of an air handler unit cabinet according to the invention.
Figure 6:
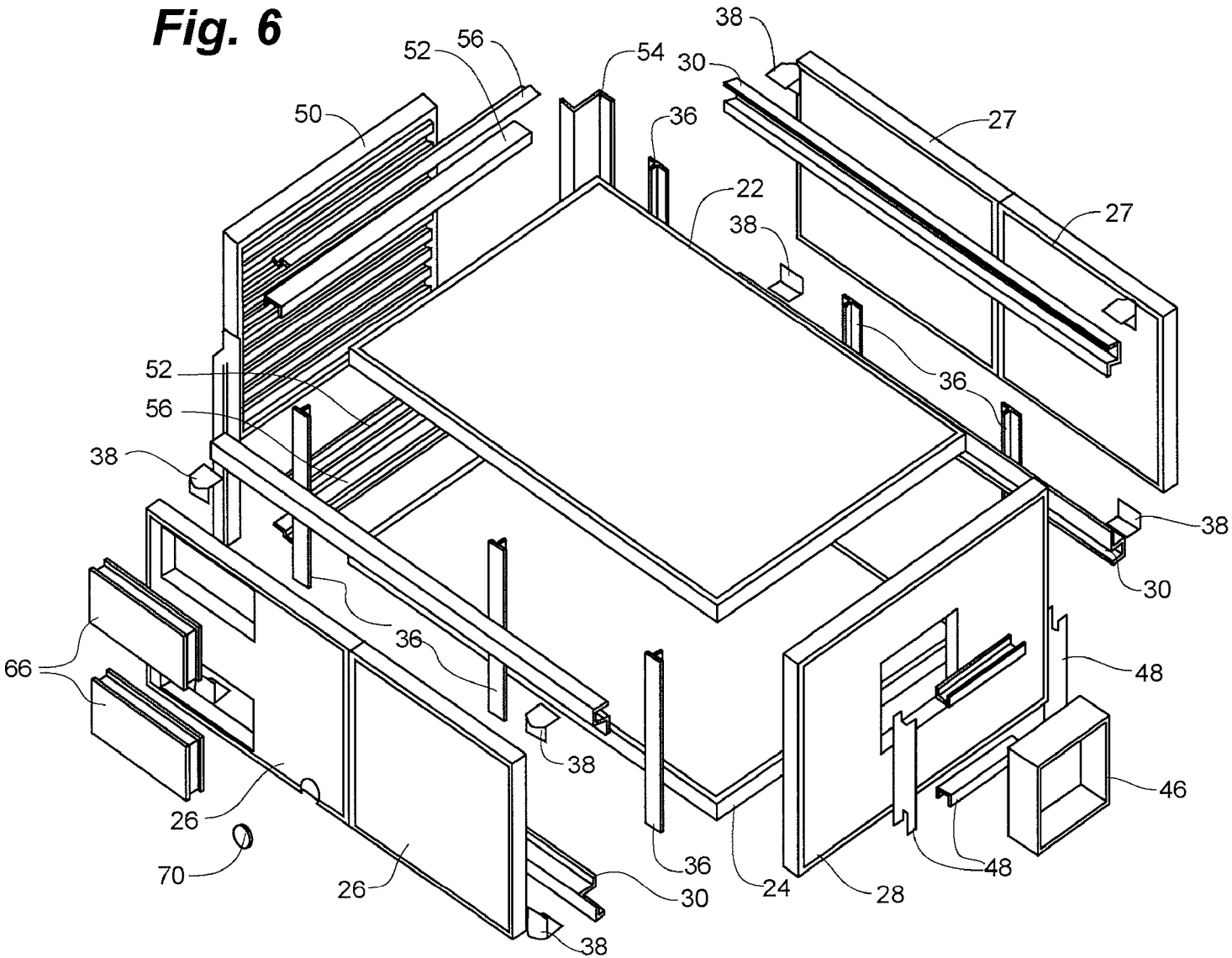
FIG. 6 is an exploded perspective view of an air handler unit cabinet according to the invention, with certain internal components removed for clarity.
Figure 7:
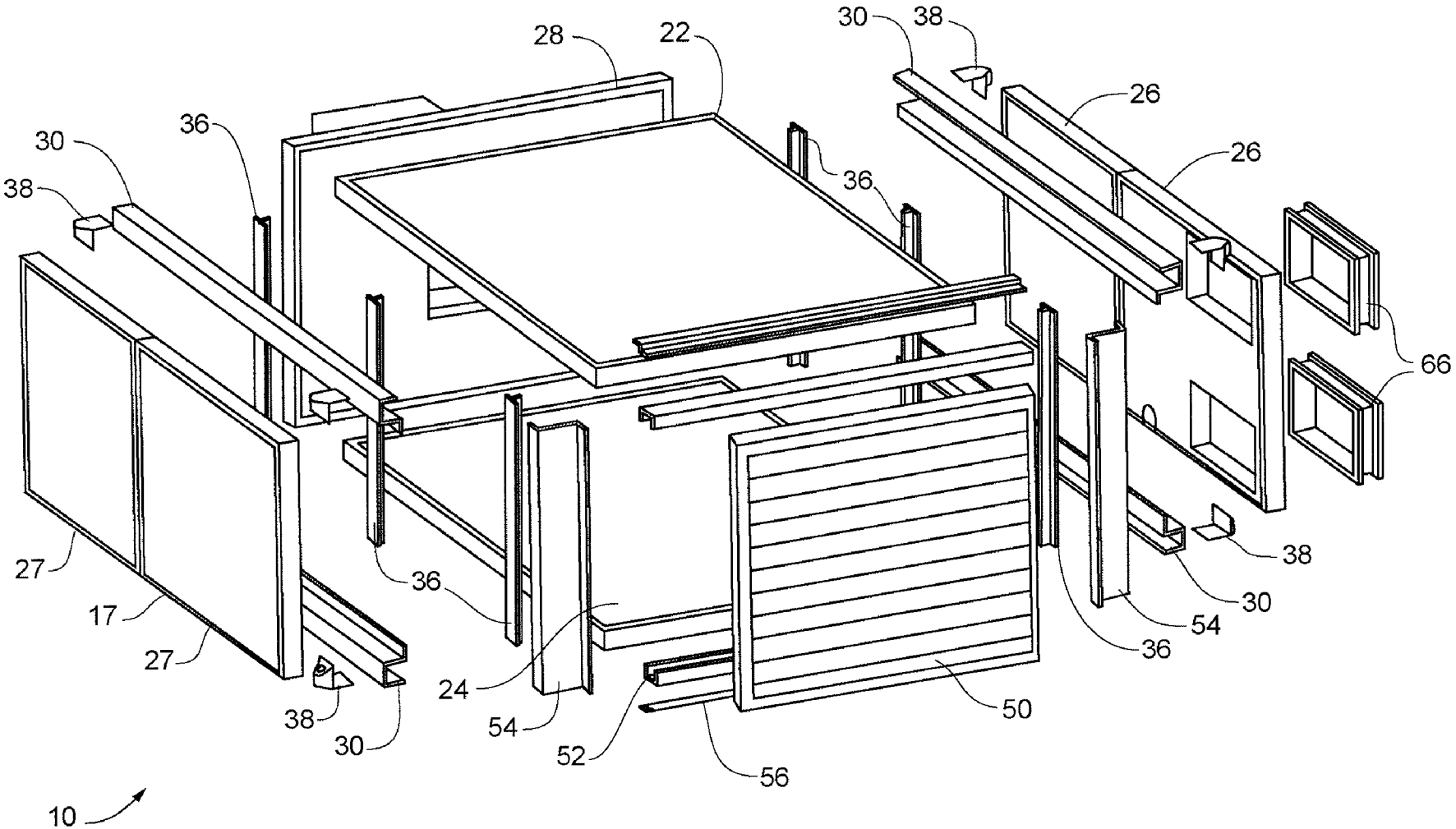
FIG. 7 is a further exploded perspective view of an air handler unit cabinet according to the invention, with certain internal components removed for clarity.

As depicted in FIGS. 3-5, air handler unit 10 may include components such as a blower fan 40, a damper 50, and a heat exchanger 60. Blower fan 40 may be located proximate first end 18, and secured to a mounting structure 42. Fan 40 is disposed proximate an outlet 44, having a shroud 46. Shroud 46 protrudes through first end panel 28, and multiple trim pieces 48 are included for securing and sealing shroud 46 into panel 28.

Damper 50 may be located proximate second end 19 of cabinet assembly 12. In a preferred embodiment shown in the figures, cabinet assembly 12 does not include a second end panel 29. Rather, damper 50 substantially occupies the entire area at second end 19. Damper 50 is secured to cabinet assembly 12 with the use of channels 52, side inserts 54, and brackets 56. Channels 52 are located on the top and bottom of damper 50, and each channel 52 partially receives a side insert 54. A portion of side insert 54 partially extends into channel 52 and abuts the side edge of damper 50, while the other portion of side insert 54 is configured to partially extend onto the outer face of a side panel 26 or 27, thereby partially securing damper 50 to the sides 16 and 17 of cabinet assembly 12. Brackets 56 are located on the top and bottom of damper 50, and are configured such that each bracket 56 partially overlaps a channel 52 and either top panel 22 or bottom panel 24, thereby securing damper 50 to the top 13 and base 14 of cabinet assembly 12. In an alternate embodiment, damper 50 may be of a smaller size, such that a second end panel 29 is included for mounting at second end 19. Second end panel 29 then includes structure for receiving a damper 50 therein and the second end panel 29 is configured similar to first end panel 28 with an aperture similar to opening 44 defined therein to accommodate the reduced size damper 50.

Heat exchanger 60 is also provided in AHU cabinet 10, and may include a drain pan 62 and a plurality of refrigerant lines 64. Drain pan 62 may be secured to bottom panel 24, and heat exchanger 60 may be secured to drain pan 62. Refrigerant lines 64 circulate refrigerant through heat exchanger 60 to a location away from AHU cabinet 10. Refrigerant lines 64 pass through first side panels 26, and inserts 66 are included in side panel 26 to provide a seal around refrigerant lines 64, as depicted in FIG. 1. Drain pan 62 includes a drain pipe 68 for evacuating condensed water collected therein, and drain pipe 68 passes through first side panel 26. A drain pipe insert 70 may be included in side panel 26 to provide a seal around drain pipe 68. Drain pan 62 may include additional drain pipes 68.

Figure 8:
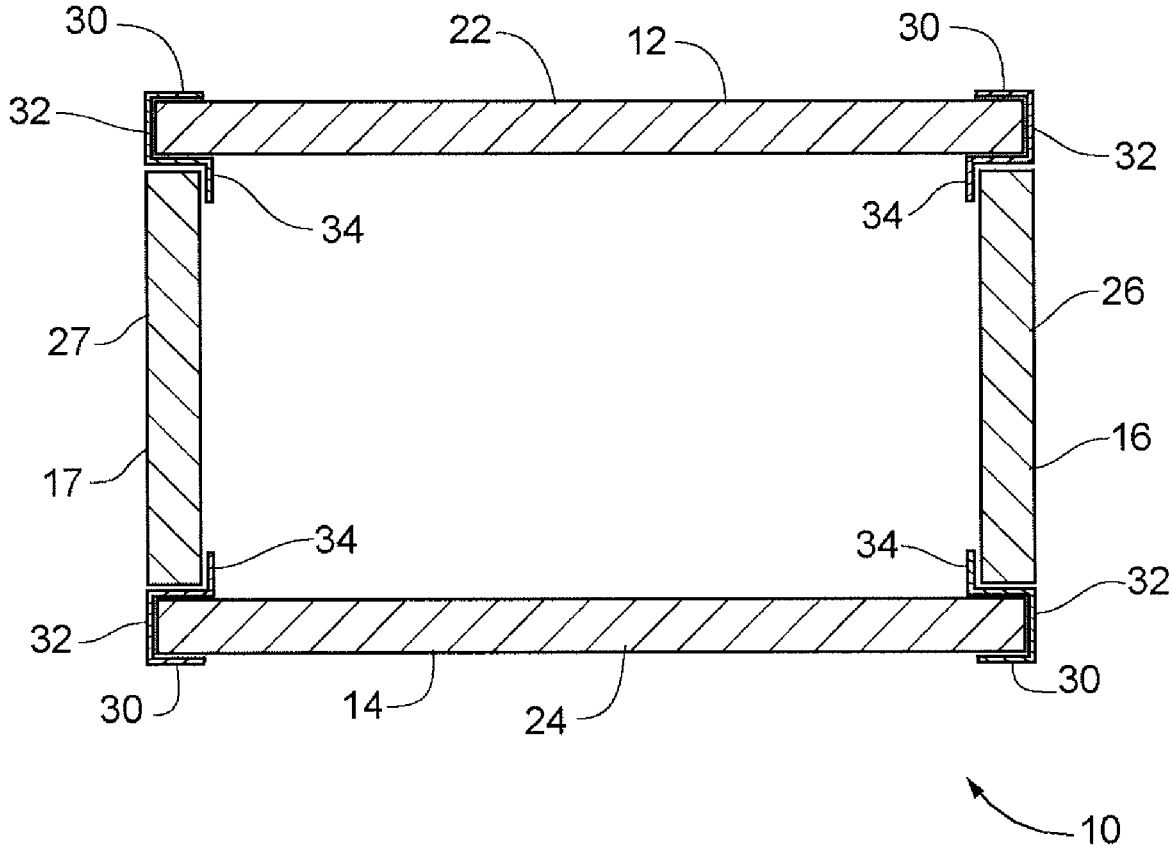
FIG. 8 is a cross-sectional view of the outer structure of an air handler unit cabinet according to the invention.
Figure 9:
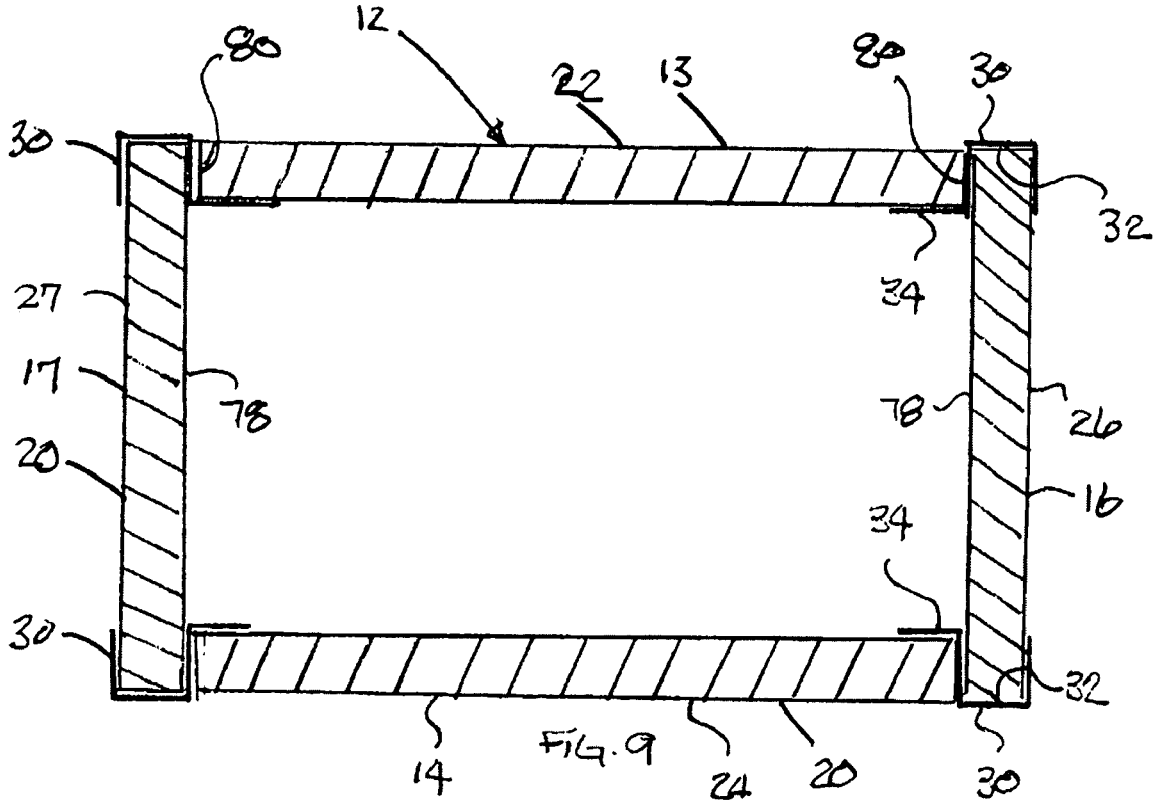
FIG. 9 is a cross-sectional view of an alternative embodiment of the outer structure of an air handler unit cabinet.

In a preferred embodiment, which is best depicted in FIGS. 8 and 9, cabinet assembly 12 is constructed such that the panel assemblies 20 provide the structural integrity of the AHU cabinet 10. Accordingly, the inner face 70 of top panel 22 is supported in part by the respective top edge margins 72 of side panels 26 and 27 and by the front and rear panels 28, 29, where the panel 22 overlies a respective front and/or rear panel 28, 29. As can be seen in FIG. 8, the side margin portions 74 of top panel 22 are received in the three sided channel 32 of the panel-mounting channel member 30. The lip 34 of each panel-mounting channel member 30 abuts the inner face 76 of each side panel 26 and 27. Each panel-mounting channel member 30 may be fastened to panel assemblies 20 with bolts, screws, adhesives, or other similar fasteners. Sealants may be used in joints between panel-mounting channel members 30 and panel assemblies 20, to further increase the energy efficiency of AHU cabinet 10. In an alternate embodiment depicted in FIG. 9, the arrangement of top and bottom panels 22 and 24 and side panels 26 and 27 is reversed, such that the inner faces 78 of side panels 26 and 27 abut the edge margins 80 of top panel 22 and bottom panel 24 and are coupled thereto by means of channel members 30.

Figure 10:
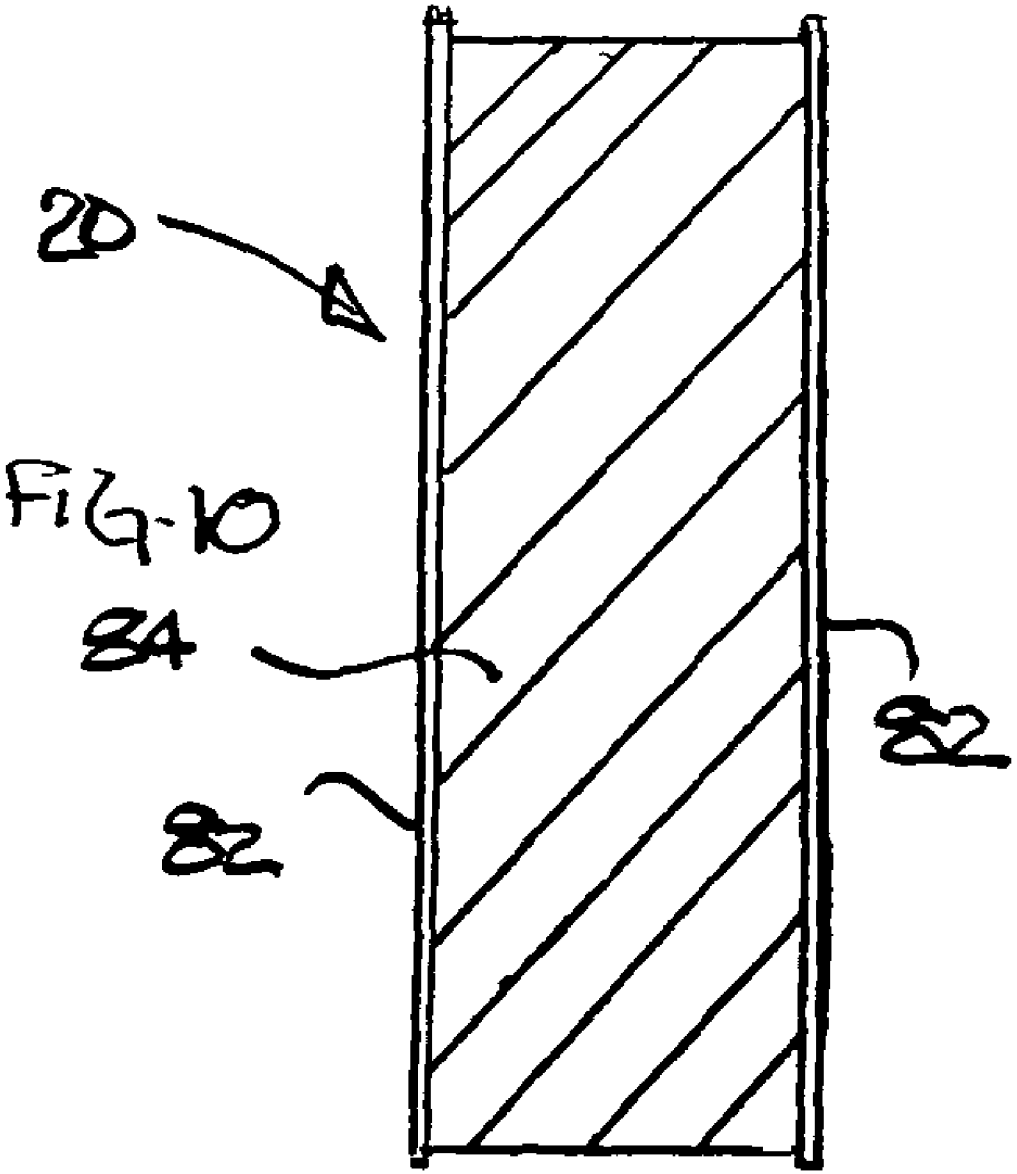
FIG. 10 is a cross-sectional view of a panel assembly.

In a preferred embodiment depicted in FIG. 10, panel assemblies 20 are constructed of a pair of metallic panels 82. Panels 82 are preferably formed of steel, preferably stainless steel, or aluminum. Panels 82 may be formed flat or corrugated. A high-density expanded polyurethane core 84 is sandwiched between the panels 82. The panels 82 are preferably bonded to the core 84 by suitable adhesives. The density of the polyurethane core 84 in such an embodiment may be approximately forty kilograms per cubic meter, however, in alternate embodiments the density may differ. The panel assembly 20 provides both thermal and acoustical insulation as well as the necessary structural strength of the AHU cabinet 10. A suitable panel assembly 20 for use in constructing air handler unit cabinet 10 is manufactured by the Metecno Group of METECNO SpA, Via Per Cassino, 19 20067 Tribiano, Milan, Italy.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

What is claimed is:

1. A cabinet for an air handling unit, comprising:

a cabinet assembly including a plurality of panel assemblies, each panel assembly being formed of two spaced apart metallic panels embracing an intermediate core;

a plurality of channel members, each channel member structurally isolated from each other channel member and independently removably coupleable to at least two panel assemblies for operably coupling the at least two panel assemblies;

wherein the plurality of panel assemblies provides structural strength to the cabinet assembly; and wherein each of the channel members is formed in a T shape and none of the channel members is directly coupled to another channel member.

2. The cabinet of claim 1, wherein each of the channel members has a channel portion for receiving a first panel assembly and a lip portion for receiving a second panel assembly substantially normal to the first panel assembly.

3. The cabinet of claim 1, the plurality of panel assemblies acting to support air handling components disposed in the cabinet assembly.

4. The cabinet of claim 1, wherein each of the plurality of panel assemblies provides thermal and acoustical insulation.

5. The cabinet of claim 1, each of the pair of spaced apart metallic panels being bonded to the intermediate core.

6. The cabinet of claim 1, the intermediate core being formed of high-density expanded polyurethane.

7. The cabinet of claim 1, wherein the cabinet is configured to substantially distribute through the plurality of panel assemblies a load borne by the cabinet assembly.

8. The cabinet of claim 1, further comprising a beam positioned intermediate the at least two panel assemblies and substantially transverse to the first and second channel members, the beam structurally isolated from the channel members.

9. A method of forming a cabinet for an air handling unit, the cabinet having a plurality of panel assemblies each formed of two spaced apart metallic panels embracing an intermediate core and a plurality of channel members, the method comprising:

forming a cabinet assembly from the plurality of panel assemblies;

coupling a first panel assembly to a second panel assembly with a first channel member;

coupling one of the first and second panel assemblies to a third panel assembly with the second channel member;

structurally isolating the first channel member from the second channel member; and providing structural strength to the cabinet assembly with the plurality of panel assemblies;

wherein each of the plurality of channel members is independently removably coupleable to at least two panel assemblies; and wherein each of the channel members is formed in a T shape and none of the channel members is directly coupled to another channel member.

10. The method of claim 9, including operably coupling the first and second panel assemblies together by means of disposing the first channel member at a juncture of the first and second panel assemblies.

11. The method of claim 9, including bonding each of the pair of spaced apart metallic panels to the intermediate core.

12. The method of claim 9, including forming the intermediate core of high-density expanded polyurethane.

13. The method of claim 9, including supporting air handling components disposed in the cabinet assembly by means of the plurality of panel assemblies.

14. The method of claim 9, further comprising coupling the second panel assembly to a fourth panel assembly with a beam, the beam positioned substantially transverse to the first and second channel members, the second and fourth panel assemblies substantially coplanar.

15. The method of claim 14, further comprising structurally isolating the beam from each of the plurality of channel members.

16. The method of claim 9, further comprising:

bearing a load with the cabinet assembly, the load applied in a first direction; and transferring the load among the plurality of panel assemblies;

wherein the load is transferred in the first direction substantially through panel assemblies.

* * * * *